US007341212B2

(12) United States Patent
Viljoen et al.

(10) Patent No.: US 7,341,212 B2
(45) Date of Patent: Mar. 11, 2008

(54) ENHANCED ORE COMMINUTION PROCESS AND APPARATUS

(75) Inventors: Richard Michael Viljoen, Sunninghill (ZA); Jan Tjeerd Smit, Roosevelt Part Ext. (ZA); Udo Meyer, Krugersdorp (ZA); Carlos Félipe Lozano-Vallejos, Ontario (CA)

(73) Assignees: Loesche GmbH, Duesseldorf (DE); Anglo American Research Laboratories (Pty) Ltd., Johannesburg (ZA)

( * ) Notice: Subject to any disclaimer, the term of this patent is extended or adjusted under 35 U.S.C. 154(b) by 121 days.

(21) Appl. No.: 10/515,916

(22) PCT Filed: May 28, 2003

(86) PCT No.: PCT/IB03/02051

§ 371 (c)(1),
(2), (4) Date: Jul. 5, 2005

(87) PCT Pub. No.: WO03/099444

PCT Pub. Date: Dec. 4, 2003

(65) Prior Publication Data

US 2005/0253002 A1 Nov. 17, 2005

(30) Foreign Application Priority Data

May 29, 2002 (DE) ..... 102 24 009
May 30, 2002 (ZA) ..... 02/4338

(51) Int. Cl.
*B02C 9/04* (2006.01)

(52) U.S. Cl. ..... 241/117; 241/119

(58) Field of Classification Search ..... 241/117, 241/119
See application file for complete search history.

(56) References Cited

U.S. PATENT DOCUMENTS

| | | | | |
|---|---|---|---|---|
| 2,848,170 | A * | 8/1958 | Crites | 241/117 |
| 4,013,235 | A * | 3/1977 | Halloran, Jr. | 241/117 |
| 4,127,237 | A * | 11/1978 | Mehta et al. | 241/58 |
| 4,798,344 | A * | 1/1989 | Fishburn | 241/79.1 |
| 5,244,157 | A * | 9/1993 | Brundiek | 241/36 |
| 5,251,831 | A * | 10/1993 | Yoshida et al. | 241/79.1 |

FOREIGN PATENT DOCUMENTS

| | | |
|---|---|---|
| DE | 42 02 784 | 8/1993 |
| EP | 04 06 644 | 1/1991 |
| GB | 428237 | 5/1935 |
| GB | 1 324 158 | 7/1973 |
| JP | 07024343 | 1/1995 |
| WO | WO9954514 | 10/1999 |

* cited by examiner

*Primary Examiner*—Faye Francis
(74) *Attorney, Agent, or Firm*—Jacobson Holman PLLC

(57) ABSTRACT

A method and apparatus for comminuting particulate material by inter-particle comminution in a bed of particles are disclosed. The apparatus includes a vertical roller mill with a horizontal grinding table rotating about a verticle mill axis. At least one grinding roller presses resiliently against a bed of particulate material on the grinding track and applies a compressive force. The geometry of the mill is such that the roller engages the bed of particulate material with a substantially pure rolling action. This minimises shear forces applied to the particle bed and minimises the reduction of fines.

8 Claims, 5 Drawing Sheets

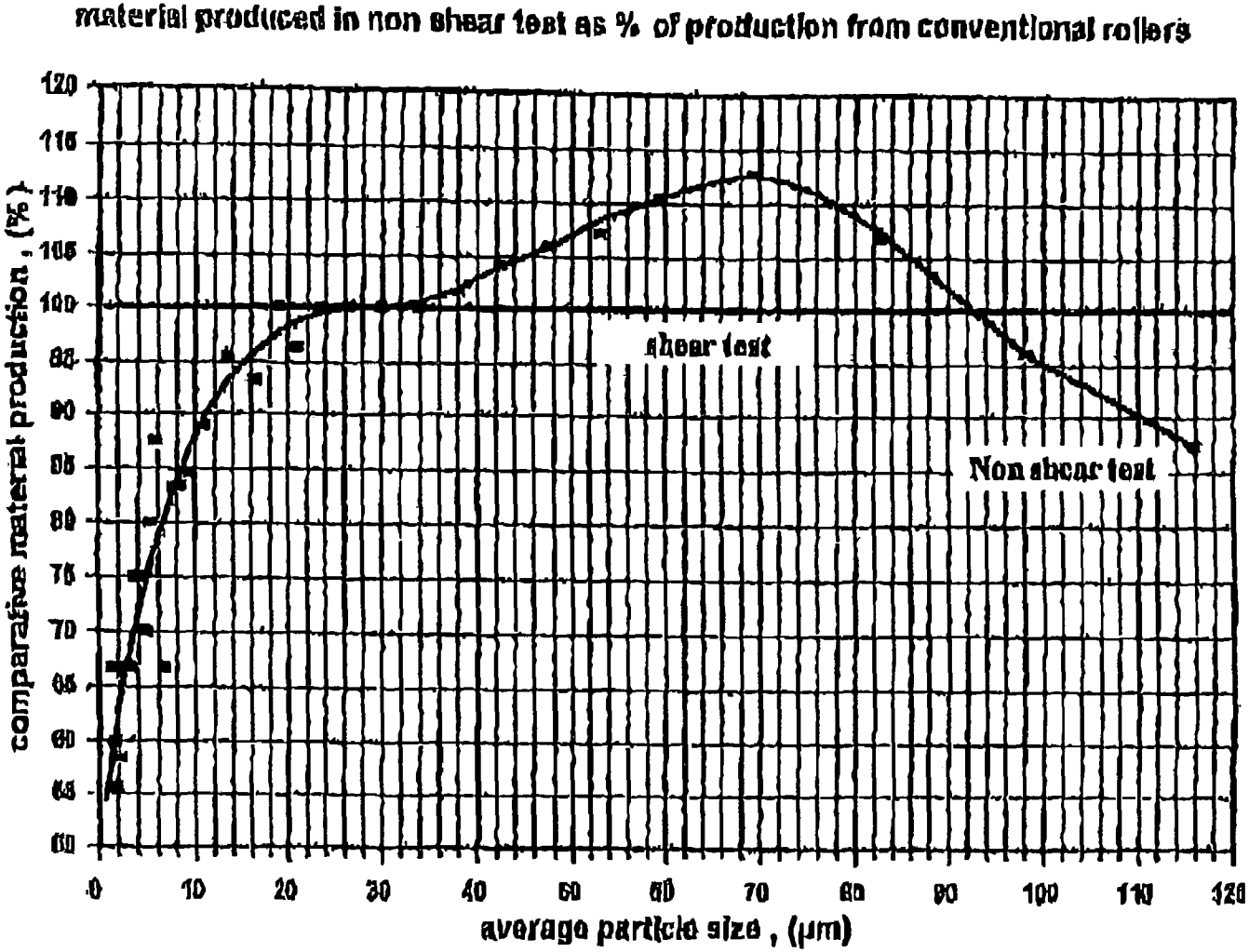
도면 9

ENHANCED ORE COMMINUTION PROCESS AND APPARATUS

This is a nationalization of PCT/IB03/02051 filed May 28, 2003 and published in English.

BACKGROUND OF THE INVENTION

This invention relates to a method and apparatus for comminuting particulate material.

International Patent Application no. PCT/IB99/00714 entitle Ore Comminution Process describes a method and installation for processing heterogeneous value bearing material by inter-particle comminution in a bed of particles, under conditions which are optimised for the subsequent recovery of desired values by improving value liberation and minimising the production of ultrafines. The method and apparatus are particularly suited for use in a base metal, precious metal or industrial mineral recovery process, and enhance the efficiency of the process by increasing the percentage of value recovery while reducing the complexity and cost of downstream processing required, whether in a froth flotation, gravity recovery or leaching process, Inter-particle comminution in a bed of particles is conveniently carried out using a high pressure grinding roll, Rhodax crusher, or other such device, but most advantageously in a vertical roller mill. In one known mill of this kind, a table defining a flat, horizontal, rotating grinding track supports a bed of particulate material to be comminuted, while two or more statically hinged conical rollers, rotting about their own axes, are pressed down onto the bed by a hydro-pneumatic tensioning system.

It is an abject of the invention to optimise apparatus of the above kind and a process utilising such apparatus for use in an ore comminution process.

SUMMARY OF THE INVENTION

According to the invention there is provided a method of comminuting particulate material by inter-particle comminution in a bed of particles, the method comprising passing a bed of particulate material between at least two grinding elements, at least one of the grinding elements being a roller arranged to apply a compressive force to the bed of particulate material to cause inter-particle comminution therein, so that said roller engages the bed of particulate material with a substantially pure rolling action, thus minimising shear forces between particles in the bed of particulate material and between said particles and the grinding elements.

The grinding elements may comprise a grinding tack which supports the bed of particulate material and at least one roller arranged above the grinding track, the method comprising passing the bed of particulate material between the grinding track and said at least one roller.

The method preferably comprises passing the bed of particulate material between at least two rollers and a grinding track in a vertical roller mill, each roller rotating about an axis which intersects the axis of the other roller or rollers and an upright axis of rotation of the grinding track, thereby to achieve a pure rolling action of the rollers relative to the bed of particulate material and thus to minimise shear forces between particles in the bed of particulate material and between said particles, the rollers and the grinding track.

Preferably, the axes of rotation of the rollers and the grinding track intersect in a plane above the grinding track and spaced from the grinding track by a distance equal to the depth of the bed of particles.

According to the invention a crushing without or with a minimum introduction of shear forces can be performed in a roller mill, if the grinding rollers roll synchronously to the rotating grinding table or the grinding track and the roller path coincides with the grinding track path of the rotating grinding table.

According to the invention a pure rolling movement and a shear force-free grinding is brought about with a roller mill having correspondingly constructed grinding rollers arranged at a clearly defined distance from the grinding table or grinding track.

A pure rolling movement and a shear force-free crushing or crushing with minimum shear force introduction into the grinding bed is advantageously brought about in that the grinding rollers are positioned in such a way that the extended roller axes form with the vertical mill axis an intersection points which is level with the grinding bed surface and intersects an imaginary horizontal of said surface.

Appropriately the grinding rollers are constructed conically and are positioned in such a way that the circumferential surface of each grinding roller and the surface of the grinding table or grinding track run horizontally and parallel to one another.

An arrangement of rollers for bringing about a pure rolling movement is known from EP 0 405 644 B1 and DE 42 02 784 A1. However, in the case of said rollers they are precompaction rollers, which are in each case positioned upstream of the grinding rollers for compacting and homogenizing the grinding bed. For the preparation of the grinding bed, the precompaction rollers rest with their own weight only and optionally with the aid of a spring damping system on said bed and do not participate in the crushing operation. In addition, the pure rolling movement of the precompaction rollers is obtained in that the axes of the precompaction rollers in extension form an intersection with the vertical rotation axis of the grinding table in the grinding track plane, but not in the grinding bed plane. The grinding rollers of the air-swept roller mills described in the aforementioned documents are positioned in such a way that shear forces are introduced into the grinding bed and a ground product with a high proportion of fines is produced.

However, the aim of the method and roller mill according to the invention is to produce a ground product free or at least with only a limited proportion of fines and which ensures an advantageous, trouble free further processing.

It has been found that roller mills with correspondingly shaped or dimensioned and arranged grinding rollers ensure a shear force-free grinding and the production of a ground product with the desired particle size distribution, on setting a grinding bed with a height of 1 to 150 mm.

It falls within the scope of the invention to obtain the pure rolling movement of the grinding rollers and the inventive intersection of the grinding roller axes with the vertical mill axis and the horizontal of the grinding bed surface with the aid of correspondingly dimensioned grinding rollers and/or with grinding rollers arranged with a corresponding inclination angle.

Fundamentally the roller mill can be constructed as an overflow mill. The ground product crushed by a pure rolling movement of the grinding rollers then passes, optionally with corresponding discharge means, over a retention ring of the grinding table and is supplied to a subsequent classification process, eg. screening or classifying.

Advantageously the crushing according to the invention is performed in an air-swept roller mill, particularly of the Loesche type, in which a classifier is integrated into the mill housing and inadequately crushed material is returned to the grinding table, whilst the ground product having the desired particle size distribution is discharged in a fluid flow.

The parameters and constructive details not described in conjunction with the crushing method and roller mill according to the invention can be established in the conventional way

BRIEF DESCRIPTION OF THE DRAWINGS

FIG. 9 is a graph showing the results of a test comparing the performance of a prior art mill and a mill of the invention.

DESCRIPTION OF EMBODIMENTS

Figure 1:
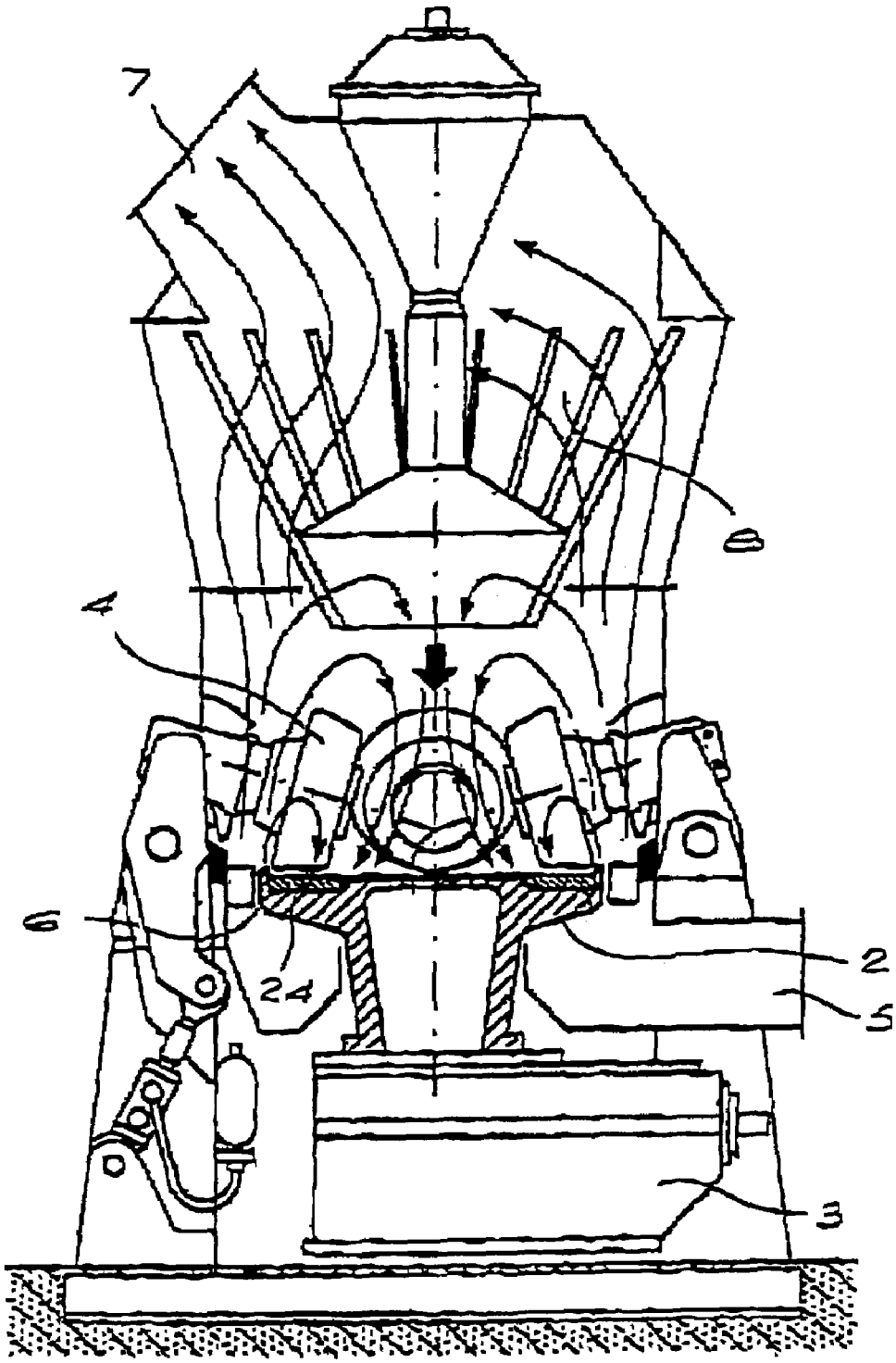
Prior Art Fig.1
FIG. 1 is a partial sectional side view of a conventional air-swept roller mill.

FIG. 1 shows a conventional air-swept roller mill of the kind manufactured by Loesche GmbH of Germany. The mill has a grinding table 2, also referred to as a grinding pan or bowl, arranged to be rotated about an upright axis by a drive 3. Several grinding rollers 4 are mounted above the table 2 and are arranged to run on an annular grinding track 24 on the upper surface of the table 2, on a grinding bed of material to be crushed. Particulate material such as ore is supplied to the grinding table from above or from the side, and the rollers bear down on the are on the grinding track crushing it by pressure comminution, A duct 5 supplies a strong flow of air via a louvre ring into the grinding zone around the table 2, so that crushed material falling off the edge of the table is lifted towards a classifier 8 near the top of the mill. Completely crushed particles are transported to an outlet 7, but oversized particles fall into the classifier 8 and are returned to the grinding zone.

Figure 2:
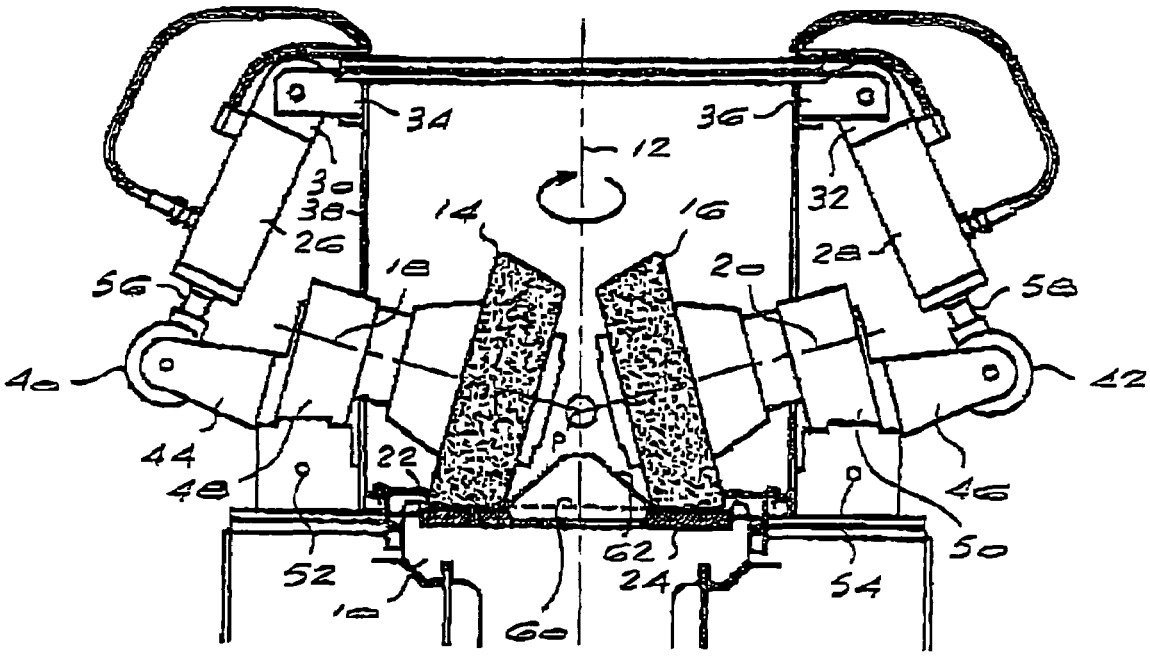
Fig 2 Prior Art
FIG. 2 is a schematic side view illustrating the geometry of the rollers in a laboratory mill.

The roller/table geometry of the conventional vertical roller mill of FIG. 1 is shown in more detail in FIG. 2. The table 10 of the mill is mounted for rotation about an upright axis 12. A pair of opposed frusto-conically tapered rollers 14 and 16 are mounted for free rotation about respective axes 18 and 20 so that as the table 10 rotates, the conically tapered rollers 14, 15 bear down an a bed of particulate material 22 supported by an annular grinding track 24 defined in the upper surface of the table 10. The grinding track 24 takes the form of a flat, horizontal annular recess in the surface of the table 10.

Respective double acting hydropneumatic actuator 26 and 28 of the shown laboratory mill are connected pivotably at respective upper ends 30 and 32 to brackets 34 and 36 extending outwardly from the housing 38 of the mill. The respective lower ends 40 and 42 of the actuators are connected pivotably to levers 44 and 46 extending rearwardly from mountings 48 and 50 which support the rollers 14 and 18 and their respective bearings. The mountings 48 and 50 are mounted pivotably in respective supports 52 and 54 so that retraction of the rods 56 and 55 of the respective actuators 26 and 28 increases the pressure exerted by the rollers on the bed of particles 22, and extension of the rods decreases the pressure.

The axes of rotation 18 and 20 of the rollers 14 and 16 intersect at a point P, where they also intersect the upright axis of rotation 12 of the table 10. It can be seen that the point P is above a horizontal plane 60 defined by the upper surface of the bed of particles 22. The plane 60 is parallel to the plane defined by the grinding track and therefore is spaced from the grinding track 24 by a distance equal to the depth of the bad of particles 22.

It can be seen that the grinding surfaces of the rollers 14, 16 are conically shaped, with a linear profile corresponding to the flat surface of the grinding track 24, and thus make line contact with the grinding track 24 (or the bed of particles 22 thereon.

As the mill operates, the table 10 is driven so that it rotates, casing corresponding rotation of the rollers 14 and 16. Fresh feed material is fed into the center of the table 10 from above and is deflected outwardly by a central upstanding cone 62 into the annular grinding track 24, to form the bed of particles 22 on the grinding track 24. The actuators 2S and 28 are operated to cause the rollers 14, 16 to apply the required force to the bed of particles 22 to achieve inter-particle comminution.

Due to the fact the axes 18 and 20 about which the rollers 14 and 16 rotate intersect with one another and with the upright axis 12 at a point which is substantially above the compacted bed of particulate material 22 between the grinding track 24 and the roller surfaces, the contact surfaces of the rollers 14 and 16 do not roll entirely true on the bed of particles 22, and there is relative acceleration between portions of the roller and grinding track surfaces, resulting in smear forces being generated between the grinding surfaces and the particles in the bed and between the particles themselves. In the conventional mill, this result is sought after, the purpose being to promote bed movement and to produce a comminuted product with high specific surface area and high proportions of ultrafines. This is particularly important in cement or coal grinding applications, for example, where fine product sizes are required.

A consequence of the above arrangement is that significant amounts of energy are absorbed due to the generated shear fortes and high wear rates of wear elements such as the rollers and grinding track are experienced. The generation of ultrafines (particles of less than 30 μm in size) is promoted.

Figure 3:
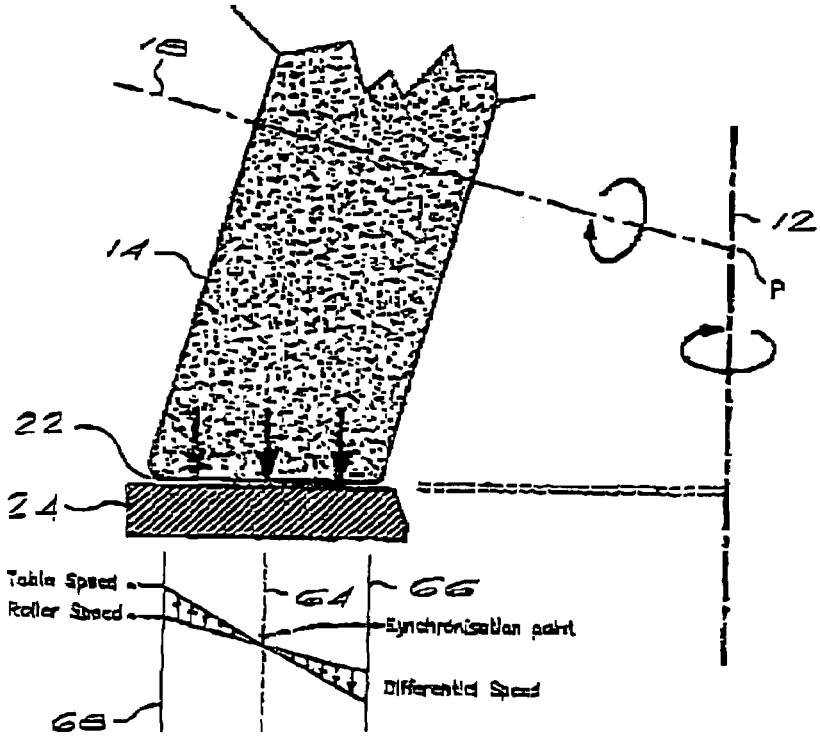
Fig 3 Prior Art
FIG. 3 is a schematic diagram illustrating the generation of shear forces in the mill of FIGS. 1 and 2.

FIG. 3 shows schematically the above effect as experienced between the roller 14 and the bed of particles 22. Due to the finite width of the roller 14 and due to the fact that it does not roll true on the particle bed 22, only single points on the lines of contact between the periphery of the roller 14 and the particle bed 22 are moving at the same speed. Thus, as indicated by the graphic projection below the particle bed 22, on either side of the centre point 64, between the innermost edge 66 and the outmost edge 68 of the particle bed 22, the differential speed between the periphery of the roller and the surface of the particle bed 22 in contact therewith will increase away from the centre point 64 towards the edges 66 and 68.

Figure 4:
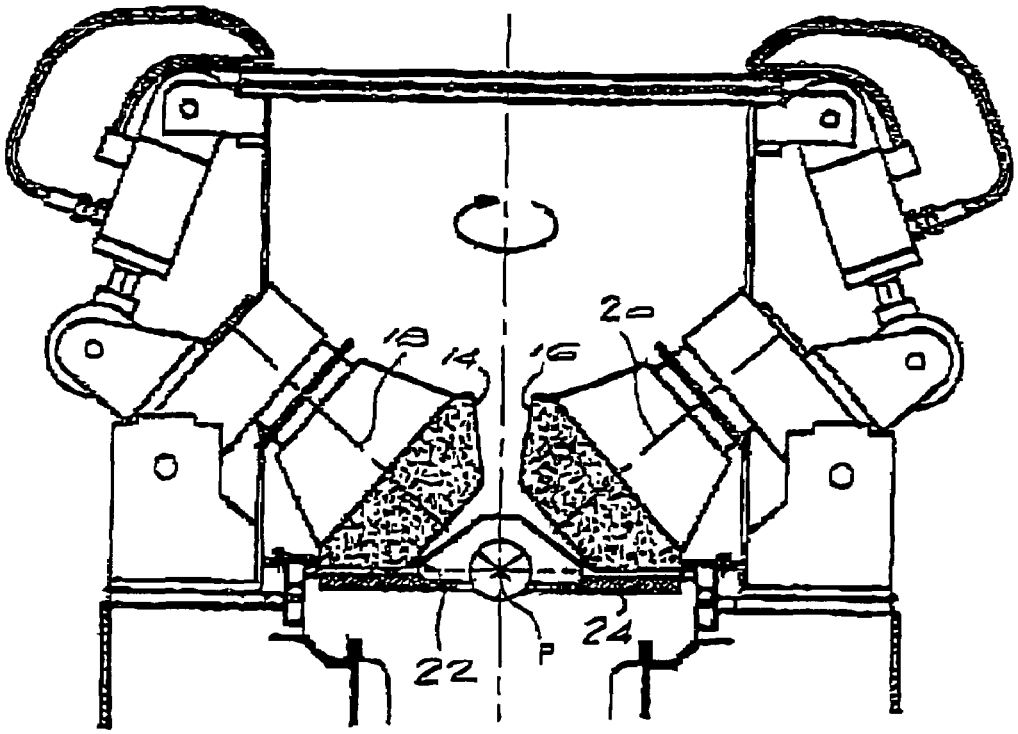
FIG. 4 is a schematic side view, similar to the view of FIG. 2, illustrating the geometry of the rollers in a vertical roller mill according to the invention.

Turning now to FIG. 4, the roller/table geometry of a modified vertical roller mill according to the invention is shown. The roller/table components of the modified mill are substantially similar to those shown in FIG. 2, and therefore the same reference numerals are used in FIGS. 2 and 4. In the modified mill of FIG. 4, the rollers 14 and 16 are adjusted so that their axes of rotation 18 and 20 intersect with one another and with the upright axis of rotation 12 of the tabs 10 at a point P which lies in a horizontal plane 60 parallel to the plane defined by the surface the grinding track 24. The plane 60 in which the point P lies is parallel to and spaced apart from the plane defined by the surface of the grinding track 24 by a distance corresponding to the depth of the compacted bed of particles 22, corresponding in other words to the position of the roller grinding surfaces in use. The point P will typically be spaced from 1 to 150 millimeters above the surface of the grinding track 24, according to the nature of the material being processed in the mill and the depth of the bed of particles.

As can be seen in FIG. 4, the peripheral grinding surfaces of the rollers 14 and 16 have a sharper conical taper than those of the rollers in FIGS. 1 to 3, to allow for the greater degree of inclination of the roller axes 18, 20.

Figure 5:
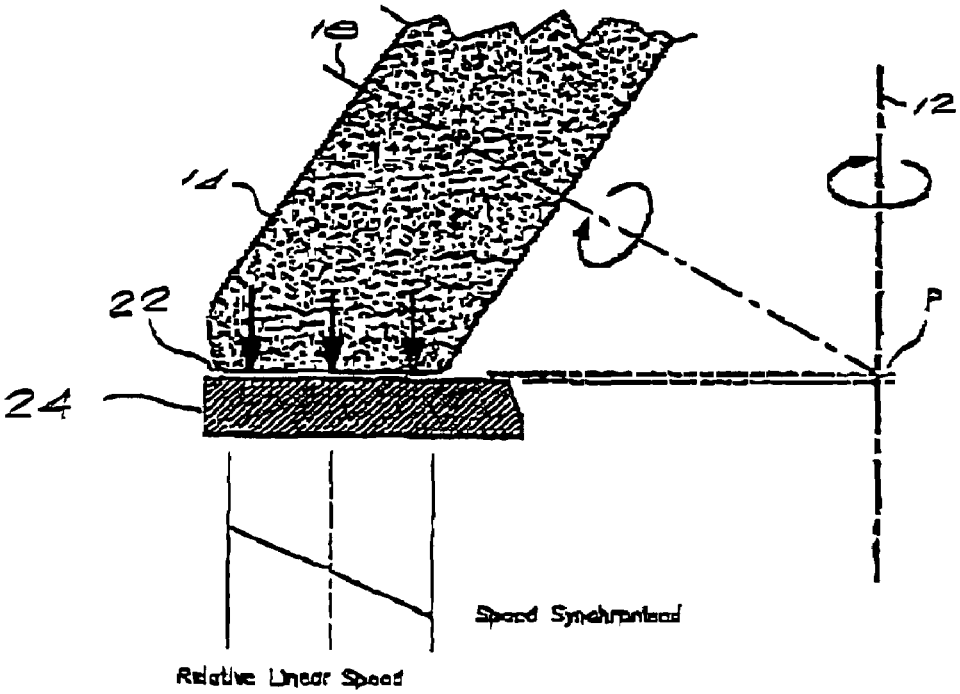
FIG. 5 is a schematic diagram, similar to the diagram of FIG. 3, illustrating the absence of shear forces in the mill of the invention.

FIG. 5 indicates the difference between the embodiment of FIGS. 1 to 3 and that of FIG. 4 in that the lines of contact between the periphery of the roller 14 and the surface of the particle bed 22 are now synchronized in speed across the width of the roller 14, substantially eliminating shear forces between the grinding surface of the roller 14 and the bed of particles 22.

Figure 6:
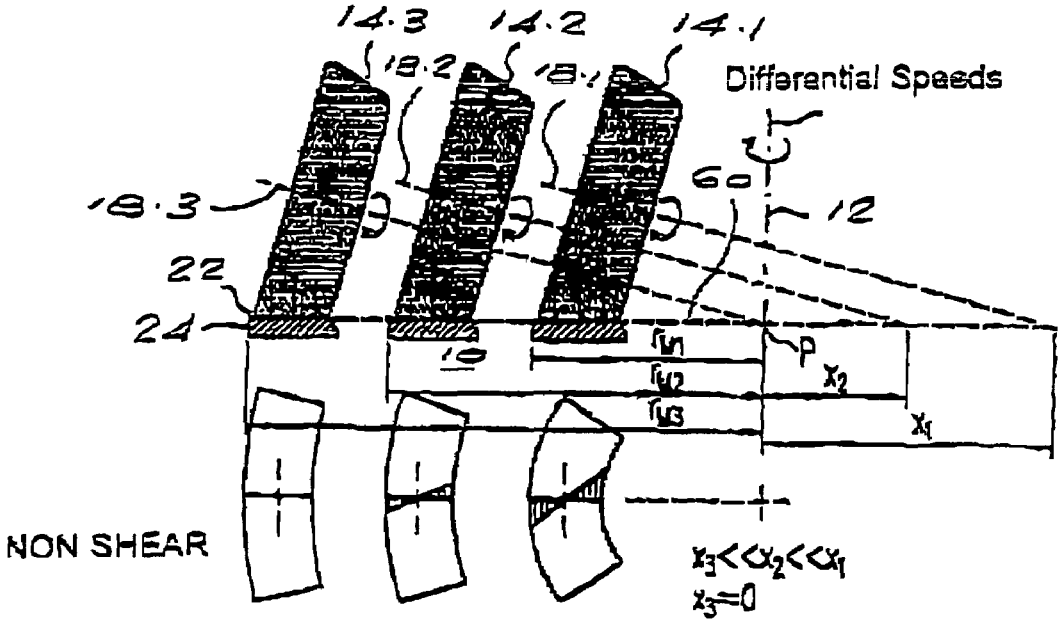
FIG. 6 is a schematic diagram illustrating the relationship between the diameter of the table defining the grinding track of the mill and the required roller geometry.

In order to achieve the required geometry to implement the concept of the invention in practice, a number of design options are available. These options can be applied singularly or in any combination that achieves the desired geometrical result, Referring to FIG. 6, it can be seen that for a given shape and diameter of roller 14, increasing the diameter of the table 10 sufficiently will result in the axes of rotation of the rollers intersecting with one another and with the upright axis of rotation of the table in the desired plane coinciding with the surface of the bed of particles. In FIG. 6, the distance $X_1$, being the distance between the upright axis 12 and the point of intersection of the axis of rotation of a roller 14.1 and the horizontal plane 60 defined by the upper surface of the bed of particles is relatively large compared with the distance $X_2$ which corresponds to a roller 14.2 which is spaced further away from the axis of rotation 12. The roller 14.3 is spaced still further away from the axis of rotation 12, so that its axis of rotation 18.3 intersects with the upright axis 12 and the plane 80 at the point $X_3$. Thus, it can be seen that compared with the conventional arrangement indicated by the position of the roller 14.1, the effect of the present invention can be achieved by sufficiently increasing the diameter of the table 10 and the grinding track 24, assuming that the rollers remain located at the periphery of the table.

FIG. 6 simultaneously illustrates the method principle according to the invention, in that through a size change of the grinding table 10 and an associated change in the grinding track radius $r_m$, it is possible to achieve a pure rolling movement of an identical grinding roller 14 and consequently a shear force free crushing. The pure rolling movement without a sliding movement is brought about iii that there is an avoidance of differential speeds or differences between the roller path and the grinding track path, which arises with an inadequate grinding track radius $r_{M1}$ and $r_{M2}$ of the grinding rollers 14.1, 14.2. Only with a grinding track radius $r_M$ does the grinding roller axis 18.3 intersect the horizontal 60 of the grinding or particulate bed surface and the mill axis 12.

Figure 7:
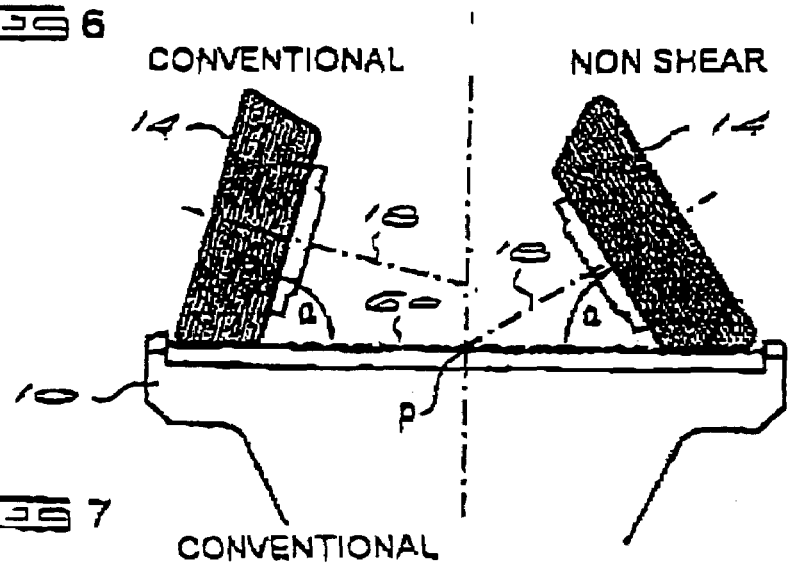
FIG. 7 illustrates schematically the relationship between the roller profile and the required roller geometry

FIG. 7 shows how the effect of the invention can be achieved by changing the roller profile in order to accommodate a change in inclination of the roller as to meet the conditions described above. In this embodiment, the conical taper of the rollers is increased (i.e. the cone angle is increased) compared to that of a conventional roller.

Whereas the grinding roller 14 on the left-hand side, as a result of its construction and an inclination angle $\alpha$ with its roller axis 18 intersects the mill axis 12 at a definite distance above the grinding or particulate bed 22, the right-hand grinding roller 14 is arranged and constructed for shear force-free grinding. The inclination angle $\alpha$ is smaller and the conicity of the grinding roller 14 is changed, so that the roller axis 18 of the right-hand grinding roller 14 intersects the mill axis 12 at point P in the level of a horizontal 60 of the surface plane of the grinding bed 22.

Figure 8:
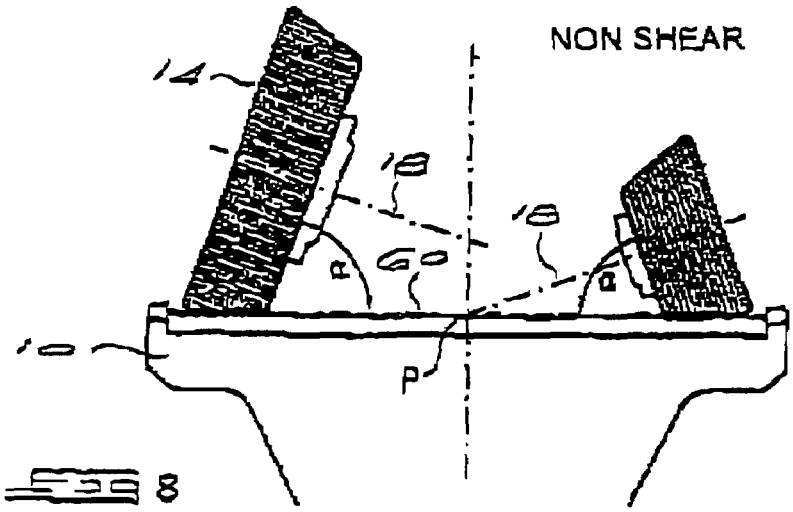
FIG. 8 illustrates the relationship between the roller diameter and the required roller geometry.

FIG. 8 shows how reducing the roller diameter without altering the conical profile of the roller periphery can achieve the same result. In practice, a combination of the above adjustments can be used as appropriate to achieve the required results.

FIG. 8 shows a further possibility for the construction of a grinding roller for shear force-free grinding. Once again the left-hand grinding roller 14 is arranged and constructed in conventional manner for shearing crushing. However, the right-hand grinding roller 14 is used far shear force-free grinding and for forming the intersection P at the level Hm of the grinding bed 22 has a modified, namely smaller roller diameter and/or a modified inclination angle $\alpha$.

FIG. 9 indicates graphically the results of a test carried out to compare the performance of the conventional mill and a mill adapted according to the principles of the invention.

A reference target particle size distribution of 90 percent passing 75 μm was used in both tests. The cure of FIG. 9 shows relative concentrations of particle diameters for non-shear comminution in a vertical roller mill of the invention compared to a normalised concentration of particle diameters in a conventional vertical roller mill. From these results it is clear that a significant reduction in the production of ultrafine material (particles of less than 30 μm) is achieved for this particular ore.

During the tests, comparative specific power consumptions were measured at the mill drive. The test of the non-shear mill of the invention exhibited a reduced specific power consumption at the targeted fineness of 40 percent when compared to the results for the conventional mill. Specific wear consumptions were measured on the grinding elements during the tests. The non-shear mill exhibited a reduced specific wear consumption at the targeted fineness of 40 percent when compared to the results for the conventional mill.

From the above description, it an be seen that by adjusting the geometry of an otherwise conventional vertical roller mil to ensure that a pure rolling action of the roller surfaces in relation to the surface of the mill grinding track and particle bed, surprisingly beneficial results are obtained. The altered geometry ensures that only compressive forces and not shear forces (or minimal shear forces) are imparted to the bed of particles. This minimises the generation of ultrafine particles, reduces the energy consumption of the mill and also reduces the specific wear rate of the grinding elements, specifically the liner of the grinding track and the liners of the grinding rollers.

The invention claimed is:

1. Apparatus for comminuting particulate material by inter-particle comminution in a bed of particles, the apparatus comprising:

a vertical roller mill having a horizontal grinding table rotating about a vertical mill axis and a grinding track defined in the upper surface of the table, and at least two stationary, rotary-mounted grinding rollers, wherein:

the at least two rollers are resiliently pressable against a grinding bed formed by the material to be crushed on the grinding table, the at least two rollers roll on the grinding bed with a pure rolling movement, the at least two rollers are one of conically and frusto-conically constructed, and the at least two rollers are positioned in such a way that the circumferential surface of each of the at least two rollers and the surface of one of the grinding table and the grinding track run horizontally and parallel to one another at a clearly defined distance wherein a common intersection point P is formed by the extended roller axes, the vertical mill axis, and a horizontal plane at height $H_m$ of the compacted grinding bed, wherein one of the height $H_m$ of the grinding bed and the corresponding point P is set in the range of 1 to 150 mm, whereby the at least two grinding rollers achieve a ground product free or at least with only a limited proportion of fines.

2. Apparatus according to claim 1 wherein the profiles of the at least two rollers are modifiable to adjust the intersection point P in the height $H_m$ of the grinding bed.

3. Apparatus according to claim 1, wherein the grinding track radius RM and the diameter of the table are modifiable to adjust the intersection point P in the height $H_m$ of the grinding bed.

4. Apparatus according to claim 1, wherein the grinding track is an annular recess defined in an upper surface of the rotatable table.

5. Apparatus according to claim 1, wherein the roller mill is constructed as an overflow mill.

6. Apparatus according to claim 1, wherein the roller mill is constructed as an air-swept roller mill and has an integrated classifier.

7. Apparatus according to claim 1, wherein the radii of the at least two rollers are modifiable to adjust the intersection point P in the height $H_m$ of the grinding bed.

8. Apparatus according to claim 1, wherein the inclination angle is modifiable to adjust the intersection point P in the height $H_m$ of the grinding bed.

* * * * *